US005766812A

United States Patent [19]

Malhotra

[11] Patent Number: 5,766,812

[45] Date of Patent: Jun. 16, 1998

[54] SUBSTRATES CONTAINING MAGNETIC COATINGS

[75] Inventor: Shadi L. Malhotra, Mississauga, Canada

[73] Assignee: Xerox Corporation, Stamford, Conn.

[21] Appl. No.: 818,756

[22] Filed: Mar. 14, 1997

[51] Int. Cl.[6] ..... G03G 15/22

[52] U.S. Cl. ..... 430/97; 428/200; 428/204; 428/203; 428/207; 156/277; 156/308.2

[58] Field of Search ..... 430/97, 99; 428/200, 428/201, 203, 204, 207, 209, 211, 689, 692; 136/277, 314; 156/308.2

[56] References Cited

U.S. PATENT DOCUMENTS

| | | | |
|---|---|---|---|
| 3,894,306 | 7/1975 | Sischka | 428/425 |
| 4,259,392 | 3/1981 | Suzuki | 428/212 |
| 5,314,747 | 5/1994 | Malhotra et al. | 428/341 |
| 5,320,902 | 6/1994 | Malhotra et al. | 428/342 |
| 5,327,201 | 7/1994 | Coleman et al. | 355/278 |
| 5,337,132 | 8/1994 | Cherian | 355/278 |

*Primary Examiner*—Christopher D. Rodee
*Assistant Examiner*—Cheryl Juska

[57] ABSTRACT

Disclosed is a method of creating simulated photographic-quality prints using non-photographic imaging, said method comprising: (a) providing a coated transparent substrate having a wrong reading toner image formed thereon using a non-photographic imaging process; (b) providing a backing substrate having one surface thereof coated with a two layered adhesive material, wherein the first layer in contact with the substrate has a polymeric binder having glass transition of less than 55° C., an antistatic agent, a light-fastness inducing agent, an optional filler and the second layer in contact with the first layer has a material with a melting temperature of greater than 50° C., an antistatic agent, a lightfastness inducing agent, an optional filler, for adhering said backing substrate to a surface of said transparent substrate containing said wrong reading toner image, said backing substrate being fabricated from a non magnetic material which is not readily receptive to magnetic writing or printing; (c) providing a third coating on another part surface of said backing substrate opposite said one surface which is magnetic, (d) providing a fourth coating on the remainder part surface of said backing substrate opposite said one surface which is scuff resistant and which is receptive to being written on with pen or pencil, and (e) adhering the transparent imaged substrate to the two layered adhesive containing side of the backing substrate.

15 Claims, 2 Drawing Sheets

SUBSTRATES CONTAINING MAGNETIC COATINGS

BACKGROUND OF THE INVENTION

The present invention is directed to creating simulated, photographic-quality prints and substrates using non-photographic imaging such as xerography and/or ink jet printing and/or copying, in combination with information recordable media.

More specifically, the present invention is directed to the production of documents that are capable of accepting magnetically readable information on one side and simulated, photographic-quality images on the other side.

The forgoing is achieved, in one embodiment of the invention, by providing substrates such as opaque Mylar®, transparent Mylar®, Melinex®, polyproylene, and the like containing magnetic coatings capable of recording information that can be read or decoded with conventional decoders on one side and with adhesive coatings for adhering non-photographic images derived from imaging processes such as xerography and/or ink jet printing and/or copying on the other side. When a transparent substrate containing a wrong reading image is adhered to the adhesive side of such the substrate containing the magnetic substrate, the end result is a robust document bearing photographic-quality images on one side and magnetically readable information on the other side. Such image bearing documents can be used for security purposes or as imaged Picture Post Cards of, for example, historical monuments such as the Taj Mahal or Mount Rushmore. The magnetic coating may cover the complete back side of the document or it may cover only some parts of the backside in which case the nonmagnetic part may be supplied with another abrasion resistant coating capable of accepting images from a pen or a pencil as well as from other marking technology such as xerography and inkjet printing.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the introduction of the Xerox 5775™ copier/printer, the Xerox 4900™ and the Fuji Xerox A-Color 635™ machine into the market place.

Notwithstanding all the recent development in the area of color printers and copiers there is room for improvement in the quality of color images on paper and synthetic substrates such as Mylar® and Teslin®. The foregoing is particularly true when trying to create photographic-quality images using non photographic processes.

Attempts at improving conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the aforementioned lamination process doesn't produce good results because typically the color toner images at the interface between the laminate and the toner do not make suitable optical contact. That is to say, the initially irregular toner image at the interface is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

Following is a discussion of additional prior art which may bear on the patentability of the present invention. In addition to possibly having some relevance to the question of patentability, these references, together with the detailed description to follow, should provide a better understanding and appreciation of the present invention. The prior art discussed herein as well as the prior art cited therein is incorporated herein by reference.

Copending application U.S. Ser. No. 08/583,913 filed on Jan. 11, 1996, now U.S. Pat. No. 5,663,023, with the named inventor Shadi L. Malhotra, discloses that coated sheets or substrates such as paper, opaque Mylar®, Teslin® or the like are utilized in the creation of simulated, photographic-quality prints formed using non photographic imaging procedures such as xerography and ink jet. A first substrate has a reverse reading image formed thereon. Such an image may be formed using conventional color xerography. A second substrate having a right reading image containing the same information as the first substrate is adhered to the first substrate. The foregoing results in a simulated photographic-quality print which has a relatively high optical density compared to prints using only the reverse reading image on the one substrate. This application including all of the references cited therein is incorporated herein by reference.

U.S. Pat. Nos. 5,327,201 and 5,337,132 granted to Robert E. Coleman on Jul. 5,1994 and to Abraham Cherian on Aug. 9,1994, respectively, disclose the creation of simulated photographic prints using xerography. To this end, reverse reading images are formed on a transparent substrate and backing substrate is adhered to the transparent substrate. U.S. patent applications Ser. Nos. 08/095,639, 08/095,622 (now U.S. Pat. No. 5,327,201), 08/095,016, 08/095,136 and 08/095,639 cited in the '132 patent are also incorporated herein by reference.

Copending U.S. patent application Ser. No. 08/720,524 filed on Sep. 30, 1996 in the name of Malhotra et al relates to a method of creating simulated, photographic-quality prints using transparent polyester substrates such as Mylar®; polyproylene, and the like. Reverse or wrong reading images are formed on the substrate using a linear or crosslinked low melt polyester toner and mixtures thereof. The reverse or wrong reading images are permanently adhered to the polyester substrate followed by the application of a backing member to the imaged transparent substrate. The backing member is characterized by being opaque and being coated with linear or crosslinked low melt polyester resin system to generate high fidelity, grain free photographic-quality images with reduced curl and improved adhesion due to similar Theological responses of the compatible materials in the toner, imaging substrate and the backing substrate. This application and the references cited therein are totally incorporated herein by reference.

BRIEF SUMMARY OF THE INVENTION

The present invention is directed to creating simulated photographic-quality images using a substrate having a coating thereon capable of containing magnetically recorded information describing the subject matter exhibited by the images. A substrate such as opaque Mylar® or the like is utilized in creating images using non-photographic imaging processes such as xerography and ink jet.

Specifically, one embodiment of the invention is directed to creating simulated photograhic-quality prints using Mylar®, a portion or all of one side of which has been coated with magnetic coatings capable of recording information that can be read or decoded with conventional decoders and with adhesive coatings for adhering non-photographic images derived from imaging processes such as xerography and/or ink jet printing and/or copying on the front side. When a transparent Mylar® substrate containing a wrong reading image is adhered to the adhesive side of such substrates, the end result is a robust document bearing photographic-quality images on one side and magnetically codeable and decodable information on the other side. Such image bearing documents can be used for security purposes or as imaged Picture Post Cards with stored background information of historical Monuments such as the Taj Mahal or Mount Rushmore. Where only a portion of the one side contains a magnetic coating, the rest of that one side of the substrate where there is no magnetic coating may be coated with an abrasion resistant, anti-slip, filled polymeric coating including adequate amounts of light color filler pigment particles such that they can be written upon, using pen or pencil as well as being receptive to xerographic imaging and ink jet printing. To this end, a Mylar® backing sheet used for the creation of the aforementioned type of the security document, or Picture Post Cards is coated with a composition comprised of a magnetic powder uniformly dispersed in a solvent such as water together with a binder such as a polyester resin, vinyl alcohol-vinyl acetate-vinyl chloride terpolymer, vinyl chloride-vinyl acetate copolymer resin, styrene-isoprene copolymer resin, polyacrylate resin, epoxy resin and the like. Optionally one can add a plasticizer, pigment dispersing agent, a viscosity modifier, and an anti-static agent. As the magnetic powder, one can use $\gamma$-$Fe_2O_3$, $Fe_3O_4$, mixed crystals of $\gamma$-$Fe_2O_3$ and $Fe_3O_4$, Cobalt-containing $\gamma$-$Fe_2O_3$, Cobalt-containing $Fe_3O_4$, Barium ferrite, Strontium ferrite and the like.

Other features of the present invention will become apparent as the following description proceeds and upon reference to the drawings, in which:

DETAILED DESCRIPTION OF THE PREFERRED EMBODIMENT OF THE INVENTION

Figure 1:
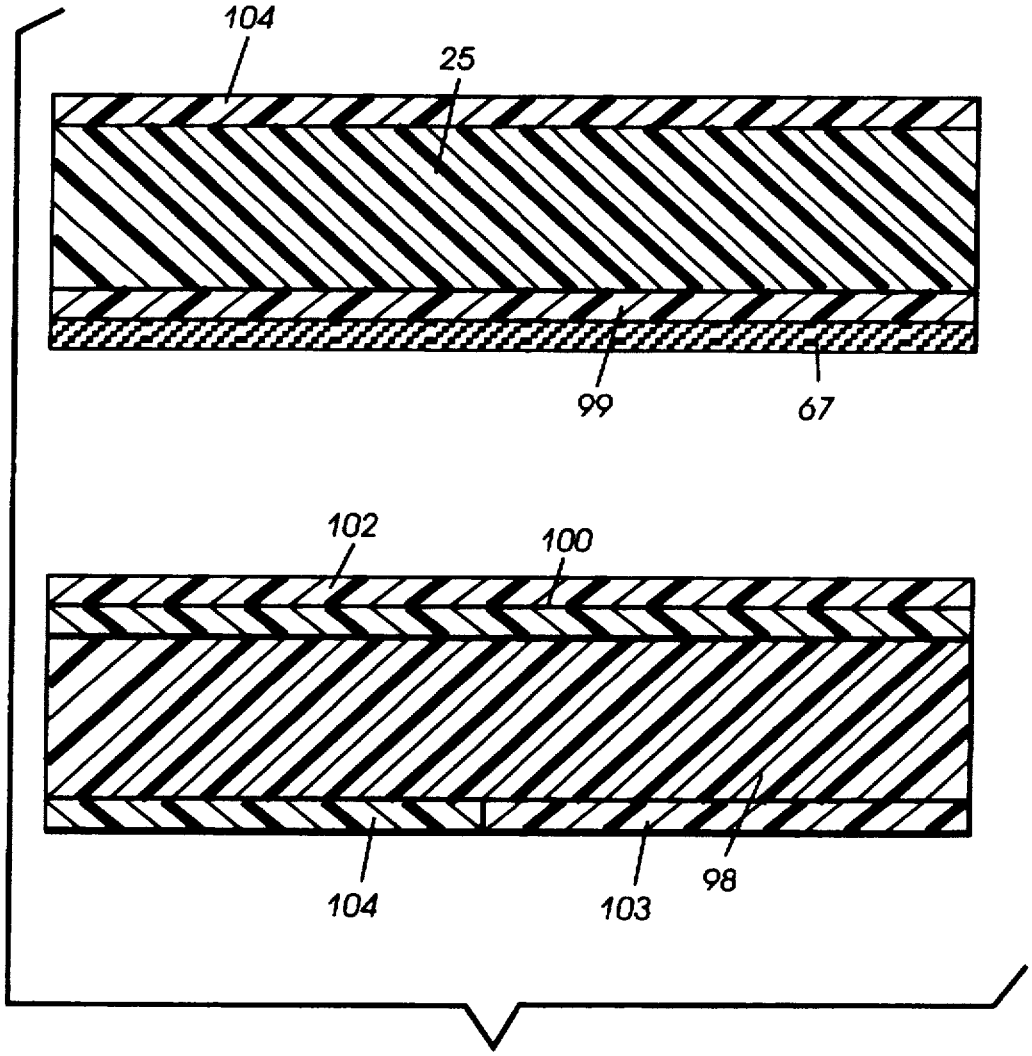
FIG. 1 is a view of a pair of substrates, one a transparency containing a reverse reading image and the other a backing substrate containing adhesive coating on the front side and a magnetically recordable coating on the back side and/or a scuff resistant coating which can be written upon with a pen, pencil, xerography and ink jet printing.

For a general understanding of the features of the present invention, reference is made to the drawings. In the drawings, like reference numerals have been used throughout to identify identical elements.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

Figure 2:
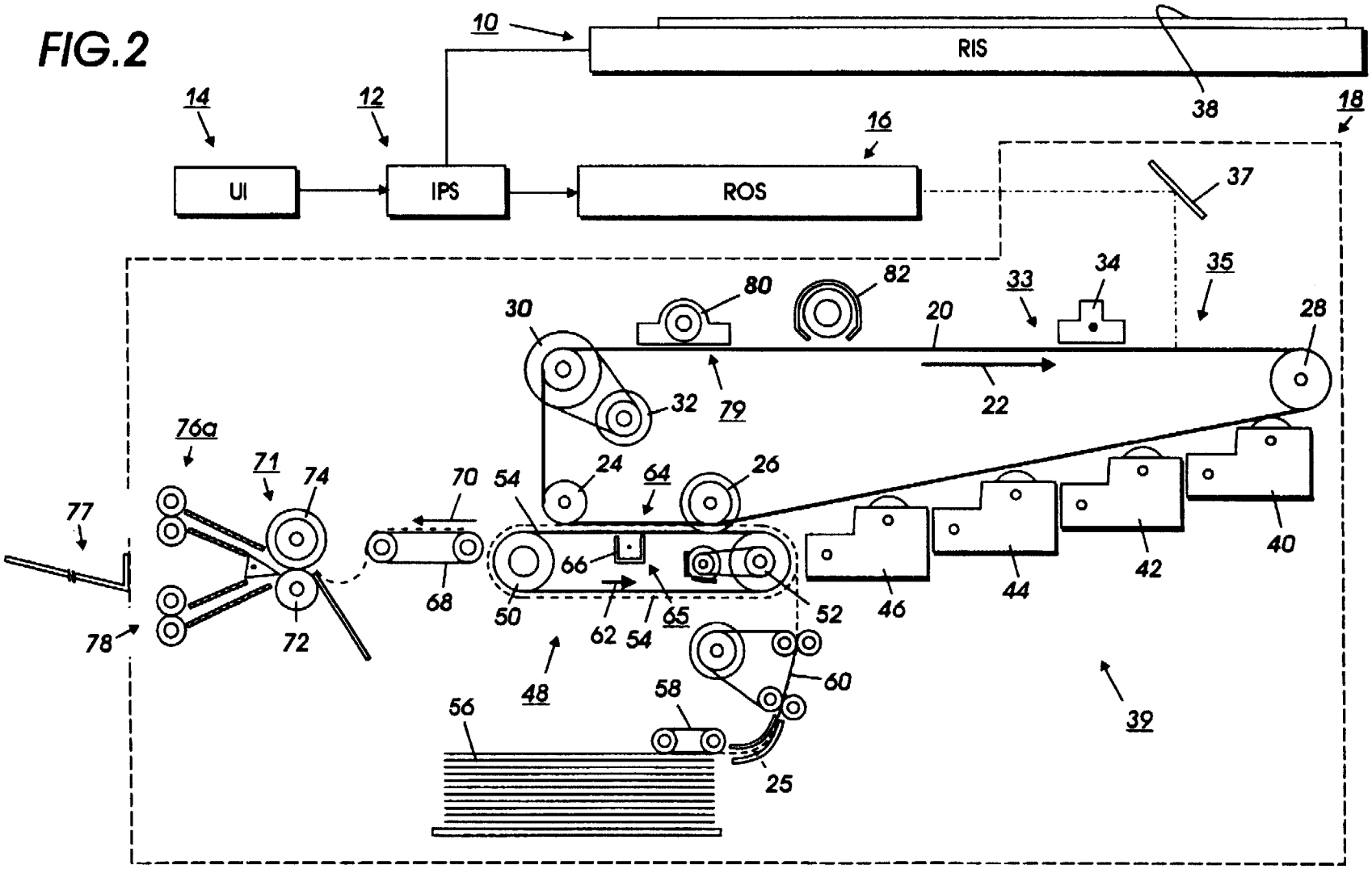
FIG. 2 is a schematic elevational view of an illustrative electrophotographic copier which may be utilized in carrying out the present invention.

Turning initially to FIG. 2, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right reading toner images on plain paper or mirror images on various other kinds of substrates utilized in the commercially available 5775™ copier. With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color photographic print. It will be appreciated that various other documents may be employed without departing from the scope and true spirit of the invention.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2 developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image.

Referring again to FIG. 2 one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed. Alternatively, the substrates can be advanced by a pair of rollers **76*a* to a catch tray 77**.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

A process and apparatus for forming simulated photographic-quality prints which use the transparency 25 containing the composite, reverse reading color image 67 and a coated backing sheet 98 are disclosed in U.S. Pat. No. 5,337,132 granted to Abraham Cherian on Aug. 9, 1994. Alternatively, simulated photographic-quality prints may be created using the apparatus and method described in U.S. Pat. No. 5,327,201 granted to Coleman et al on Jul. 5,1994.

Illustrative examples of commercially available internally and externally (surface) sized papers include Diazo papers, offset papers such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc and the like.

Examples of substantially transparent substrate materials include polyesters, including Mylar®, available from E. I. Du Pont de Nemours & Company, Melinex®, available from Imperial Chemicals, Inc., Celanar®, available from Celanese Corporation, polyethylene naphthalates, such as Kaladex® PEN Films, available from Imperial Chemicals, Inc., polycarbonates such as Lexan®, available from General Electric Company, polysulfones, such as those available from Union Carbide Corporation, polyether sulfones, such as those prepared from 4,4'-diphenyl ether, such as Udel®, available from Union Carbide Corporation, those prepared from disulfonyl chloride, such as Victrex®, available from ICI Americas Incorporated, those prepared from biphenylene, such as Astrel®, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar® being preferred in view of its availability and relatively low cost. The substrate can also be opaque, including opaque plastics, such as Teslin®, available from PPG Industries, and filled polymers, such as Melinex®, available from ICI. Filled plastics can also be employed as the substrate, particularly when it is desired to make a "never-tear paper" recording sheet.

The substrates can be of any effective thickness. Typical thicknesses for the substrate are from about 50 to about 500 microns, and preferably from about 100 to about 125 microns, although the thickness can be outside these ranges.

Each of the substrates 25 and 98 may be provided with one or more coatings for producing enhanced simulated color photographic-quality prints using non photographic imaging processes such as xerography. Each substrate is preferably coated on one side with at least one coating.

The transparent substrate 25 is coated on both sides with a hydrophilic polymer coating 99.

In a first coating 100 applied to one side of the backing sheet 98, a binder may be present in any effective amount; typically the binder or mixture thereof is present in amounts of from about 10 percent by weight to about 90 percent by weight although the amounts can be outside of this range. An optional antistatic agent, biocide and/or filler may be included in the coating 100. The coating 100 may contain a lightfastness material for minimizing color degradation due to UV light. The coating 100 preferably comprises a heat and pressure activated adhesive polymer having a glass transition temperature less than 55° C.

A second coating 102 applied to the first coating 100 also comprises a hydrophilic polymeric binder having a melting point above 50° C. The purpose of the second coating is prevent the adhesive binder from being active until it is exposed to heat and pressure. Moreover, the second coating is a wetting agent which effects spreading of the writing materials on the transparent substrate 25.

A third coating 103 which is applied to the opposite side or surface (i.e. the side opposite the side to be adhered to the imaged transparency) of the backing sheet 98 includes a magnetic coating. To this end, a Mylar® backing sheet used for the creation of the aforementioned type of the security document, is coated on the nonadhesive side with a composition comprised of a magnetic powder uniformly dispersed in a solvent together with a binder such as a polyester resin, vinyl alcohol-vinyl acetate-vinyl chloride terpolymer, vinyl chloride-vinyl acetate copolymer resin, styrene-isoprene copolymer resin, polyacrylate resin, epoxy resin and the like. Optionally one can add a plasticizer, pigment dispersing agent, a viscosity modifier, and an antistatic agent. As the magnetic powder, one can use $\gamma$-$Fe_2O_3$, $Fe_3O_4$, mixed crystals of $\gamma$-$Fe_2O_3$ and $Fe_3O_4$, Cobalt-containing $\gamma$-$Fe_2O_3$, Cobalt-containing $Fe_3O_4$, Barium ferrite, Strontium ferrite and the like. The magnetic coating is generally applied on one side of the base Mylar® so that it does not interfere when the nonmagnetic side is being printed with other printing processes such as inkjet or xerography.

In the third coating 103 applied to certain parts of the back side of the backing sheet 98, a binder may be present in any effective amount; typically the binder or mixture thereof is present in amounts of from about 20 percent by weight to about 50 percent by weight although the amounts can be outside of this range. The magnetism imparting compound or mixture thereof is present in amounts of from about 70 percent by weight to about 20 percent by weight although the amounts can be outside of this range. The dispersing agents used to disperse the magnetism imparting compound or mixture thereof is present in amounts of from about 10 percent by weight to about 30 percent by weight although the amounts can be outside of this range. Typically, the total thickness of the coating layer is from about 0.1 to about 25 microns and preferably from about 0.5 to 10 microns, although the thickness can be outside of these ranges A fourth non-magnetic coating 104 which is also applied to the opposite side or surface (i.e. the side opposite the side to be adhered to the imaged transparency) of the backing sheet 98 includes abrasion resistant, anti-slip, filled polymeric coating containing adequate amounts of light color filler pigment particles such that they can be written upon in using pen or pencil as well as being receptive to ink jet and xerographic imaging. In the fourth coating 104 applied to certain parts of the back side of the backing sheet 98, a binder may be present in any effective amount; typically the binder or mixture thereof is present in amounts of from about 20 percent by weight to about 50 percent by weight although the amounts can be outside of this range. The filler or mixture thereof is present in amounts of from about 70 percent by weight to about 20 percent by weight although the amounts can be outside of this range. The dispersing agents used to disperse the filler or mixture thereof is present in amounts of from about 10 percent by weight to about 30 percent by weight although the amounts can be outside of this range. Typically, the total thickness of the coating layer is from about 0.1 to about 25 microns and preferably from about 0.5 to 10 microns, although the thickness can be outside of these ranges Examples of suitable adhesive polymers for use as coating 100 for adhering backing substrates to imaged transparent substrates include water dispersible polymers such as those disclosed in one or more of the references noted above.

In addition, the first coating 100 may contain lightfastness inducing agents including UV absorbing compounds, lightfastness inducing antioxidant compounds, and lightfastness inducing antiozonants such as those disclosed in one or more of the above noted references.

Examples of suitable hydrophilic binder polymers for use as coating 102 for preventing premature activation of adhesive polymers comprising the first coating 100 and which serves as a wetting agent include:

poly (oxy methylene), such as #009, available from Scientific Polymer Products, poly (oxyethylene) or poly (ethylene oxide), such as POLY OX WSRN-3000, available from Union Carbide Corporation, ethylene oxide/propylene oxide copolymers, such as ethylene oxide/propylene oxide/ethylene oxide triblock copolymer, such as Alkatronic EGE-31-1, available from Alkaril Chemicals, propylene oxide/ethylene oxide/propylene oxide triblock copolymers, such as Alkatronic PGP 3B-1, available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8, available from BASF Corporation, ethylene oxide/2-hydroxyethylmethacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobis isobutyronitrile as initiator and reacting the resulting amino-semitelechelic oligo-hydroxyethyl methacrylate or amino-hydroxypropyl methacrylate with an isocyanate-polyethylene oxide complex in chlorobenzene at 0° C., and precipitating the reaction mixture in diethylether, filtering and drying in vacuum, ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor, ionene/ethylene oxide/ionene triblock copolymers, which can be synthesized via quaternization reaction of one end of each 3—3 ionene with the halogenated (preferably brominated) poly(oxyethylene) in methanol at about 40° C., ethylene oxide/isoprene/ethylene oxide triblock copolymers, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, and epichlorohydrin-ethyleneoxide copolymer such as #155 available from Scientific Polymer Products as well as mixtures thereof.

The preferred oxyalkylene containing polymers are poly (ethylene oxide), poly (propylene oxide), and ethylene oxide/propylene oxide block copolymers because of their availability and lower cost The second coating 102 in contact with the first coating composition 100 is present on the backing substrate of the present invention in any effective thickness. Typically, the total thickness of the third coating layer is from about 0.1 to about 25 microns and preferably from about 0.5 to 10 microns, although the thickness can be outside of these ranges Examples of suitable polymers for use as coating 103 which is magnetic, and 104 which is hydrophobic, abrasion resistant, anti-slip, and which can be written upon using pen or pencil as well as being receptive to inkjet and xerographic imaging include: derivatives and copolymers of poly (vinyl acetate) such as poly (vinyl formal), such as #012, available from Scientific Polymer Products,poly (vinyl butyral), such as #043, #511, #507, available from Scientific Polymer Products, vinyl alcohol-vinyl butyral copolymers such as #381, available from Scientific Polymer Products, vinyl alcohol-vinyl acetate copolymers such as #379, available from Scientific Polymer Products, vinyl chloride-vinyl acetate copolymers such as #063,#068, #070, #422 available from Scientific Polymer Products; vinyl chloride copolymers such as vinyl chloride-vinyl acetate- vinyl alcohol terpolymers such as #064,#427, #428 available from Scientific Polymer Products, vinyl chloride -vinylidene chloride copolymers such as #058, available from Scientific Polymer Products, vinylidene chloride-acrylonitrile copolymers such as #395, #396, available from Scientific Polymer Products; substituted cellulose esters such as cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, (acrylamidomethyl) cellulose acetate butyrate, such as #43, 106-0 available from Aldrich Chemical Company, cellulose propionate such as #2052, available from Scientific Polymer Products; polystyrene and derivatives there of such as polystyrene such as #039A, #039D, #845, #756 available from Scientific Polymer Products, poly (4-methylstyrene) such as #593, #839, available from Scientific Polymer Products, poly (α-methylstyrene) such as #2055, available from Scientific Polymer Products, poly (tert-butylstyrene), such as #177, available from Scientific Polymer Products, poly (2-chlorostyrene), such as #777, available from Scientific Polymer Products, poly (3-chlorostyrene), such as #778, available from Scientific Polymer Products, poly (4-chlorostyrene), such as #257, available from Scientific Polymer Products, poly (2-bromostyrene), such as #775, available from Scientific Polymer Products, poly (3-bromostyrene), such as #776, available from Scientific Polymer Products, poly (4-bromostyrene), such as #212, available from Scientific Polymer Products, poly (4-methoxy styrene), such as #314, available from Scientific Polymer Products, poly (2,4,6-tribromostyrene), such as #166, available from Scientific Polymer Products, styrene-butylmethacrylate copolymers, such as #595, available from Scientific Polymer Products, styrene-acrylonitrile copolymers, such as #495, available from Scientific Polymer Products, styrene-allyl alcohol copolymers, such as #393, #394 available from Scientific Polymer Products; poly(vinyl pyridine) and its derivatives such as poly(2-vinyl pyridine) such as #813,#814 available from Scientific Polymer Products, poly(4-vinyl pyridine) such as #700,#840 available from Scientific Polymer Products, poly(2-vinyl pyridine-co-styrene) such as #319, available from Scientific Polymer Products, poly(4-vinyl pyridine-co-styrene) such as #416,#859 available from Scientific Polymer Products, poly (4-vinyl pyridine-co-butylmethacrylate) such as #312,#667, #858, available from Scientific Polymer Products, poly (vinyl toluene) such as #261, available from Scientific Polymer Products,poly(2-vinyl naphthalene) such as #163, available from Scientific Polymer Products; poly alkyl methacrylates and their derivatives such as poly (methylmethacrylate) such as #037A, #037B, #037D, #307, #424, #689, available from Scientific Polymer Products, poly(ethyl methacrylate) such as #113, #308, available from Scientific Polymer Products,poly(isopropyl methacrylate) such as #476, available from Scientific Polymer Products, poly(phenyl methacrylate) such as #227, available from Scientific Polymer Products, poly(phenoxy ethyl methacrylate) such as #893, available from Scientific Polymer Products, poly(2-hydroxypropyl methacrylate) such as #232, available from Scientific Polymer Products, polyamide resin such as #385, #386,#387, #388, #389, #390, available from Scientific Polymer Products; polysulfones and its derivatives such as poly (p-phenylene ether-sulfone) (such as #392, available from Scientific Polymer Products), polysulfones, such as #046, available from Scientific Polymer Products; polycarbonate and its copolymers such as aromatic ester carbonate copolymers, such as APE KLI-9306, APE KLI-9310, available from Dow Chemical Company, poly carbonates, such as #035, available from Scientific Polymer Products; dimethylsiloxane copolymers such as α-methylstyrene-dimethylsiloxane block copolymers, such as PS 0965, available from Petrarch Systems, dimethyl siloxane-bisphenol A carbonate block copolymers, such as PSO99, available from Petrarch Systems, poly (2,6-dimethyl p-phenylene oxide), such as #126, available from Scientific Polymer Products.

In addition, the third coating 103 contains magnetic compounds including: $\gamma$-$Fe_2O_3$, #31,005-5, available from Aldrich Chemical Company; $Fe_3O_4$ , #31,006-9, available from Aldrich Chemical Company; mixed crystals of $\gamma$-$Fe_2O_3$ and $Fe_3O_4$, Chromium oxide, #20,216-9, available from Aldrich Chemical Company, and cobalt oxide #22,164-3, available from Aldrich Chemical Company, containing $\gamma$-$Fe_2O_3$, Barium ferrite, #38,329-5, available from Aldrich Chemical Company, Strontium ferrite and the like.

In addition, the third coating 103 contains magnetic-compound-dispersing agents including: 2-amino-2-methyl-1-propanol, available as AMP-95, from Angus Corporation; 2-amino-2-methyl-1,3-propane diol, available as AMPD, from Angus Corporation; 2-amino-2-ethyl-1,3-propane diol, available as AEPD, from Angus Corporation; 2-nitro-1-butanol, available as NB, from Angus Corporation; 2-nitro-2-ethyl-1,3-propane diol, available as, available as NEPD, from Angus Corporation; imidazoline compounds such as oleic hydroxyethyl imidazoline, available as Alkazine-O, from Rhone-Poulenc Corporation; stearyl-hydroxyethyl imidazoline, available as Alkazine ST, from Rhone-Poulenc Corporation; Tall Oil hydroxyethyl imidazoline, available as Alkazine-TO, from Rhone-Poulenc Corporation; alkyl poly (ethyleneoxy)glycol amide, available as Antarox G-200, from Rhone-Poulenc Corporation; poly ethylene glycol based esters such as those available as Acconon Series from Capital City Corporation; Alkyl trimethyl ammonium halides, such as those available as Adogen Series, from Sherex Corporation; Alkyl amines such as tallow amines such as those available as Accmeen Series from Capital City Corporation; poly ethylene glycol amines, such as those available as Alkominox Series from Rhone-Poulenc Corporation; 2-phosphino-butane-tricarboxylic acid-1,2,4, available as Bayhit-Am, from Mobay Corporation; mono, di, and tetra sodium alkyl sulfosuccinates available as Aerosol Series, from American Cynamid Corporation; sodium naphthalene sulfonate and formaldehyde condensate available as Ablusol NT, from Taiwan company; sodium tetraborate decahydrate, available as Borax, from U.S. Borax company; poly-L-glutamate sodium salt, available as Ajicoat SPG, from (Ajinomoto Company);polyacrylate sodium salt, available as Alcoperse #107,#124,#149,#157 and, polyacrylate ammonium salt, available as Alcoperse #249, from Alco Corporation; poly naphthalene sulfonate sodium salt, available as Lomar D, from Henkel Corporation; and the like.

In addition, the fourth coating 104 may contain lightfastness inducing agents including UV absorbing compounds, antioxidants and antiozonants similar to the ones used in coating 104 including, glycerol 4-amino benzoate, available as Escalol 106, from Van Dyk Corporation; resorcinol mono benzoate, available as RBM, from Eastman Chemicals; octyl dimethyl amino benzoate, available as Escalol 507, from Van Dyk Corporation; didodecyl-3,3'-thiodipropionate, available as Cyanox, LTDP, #D12,840-6, from Aldrich chemical company; ditridecyl-3,3'-thiodipropionate, available as Cyanox 711, #41,311-9, from Aldrich chemical company); N-isopropyl-N'-phenyl-phenylene diamine, available as Santoflex IP, from Monsanto-Chemicals; N-(1,3-dimethylbutyl)-N'-phenyl-phenylene-diamine, available as Santoflex 13, from Monsanto Chemicals; N,N'-di(2-octyl)-4-phenylene diamine, available as Antozite-1, from Vanderbilt Corporation; and the like.

In addition, the fourth coating 104 may contain antistatic agents. Antistatic components can be present in any effective amount, and if present, typically are present in amounts of from about 0.5 to about 20.0 percent by weight of the coating composition.

Suitable antistatic agents include both anionic and cationic materials.

Monoester sulfosuccinates, diester sulfosuccinates and sulfosuccinamates are anionic antistatic components which have been found suitable for use in the first coating. Suitable cationic antistatic components comprise diamino alkanes; quaternary salts; quaternary acrylic copolymer latexes such as HX-42-1, HX-42-3 available from Inter Polymer Corporation; ammonium quaternary salts as disclosed in U.S. Pat. No. 5,320,902 (Malhotra et al); phosphonium quaternary salts as disclosed in Copending application U.S. Ser. No. 08/034,917; and sulfonium, thiazolium and benzothiazolium quaternary salts as disclosed in U.S. Pat. No. 5,314,747 (Malhotra and Bryant)

In addition, the fourth coating 104 may contain light color filler pigment particles which exhibit a light color. Pigments can be present in any effective amount, and if present, typically are present in amounts of from about 1 to about 75 percent by weight of the coating composition. Examples of pigment components include zirconium oxide (SF-EXTRA available from Z-Tech Corporation), colloidal silicas, such as Syloid 74, available from Grace Company (preferably present, in one embodiment, in an amount of from about 10 to about 70 percent by weight percent), titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener pigments can enhance color mixing and assist in improving print-through in recording sheets of the present invention.

In one embodiment, the fourth coating on the back of the backing substrate comprises an abrasion resistant coating containing a binder present in an amount of from about 80 percent by weight to about 30 percent by weight, a pigment dispersant present in an amount of from about 10 percent by weight to about 20 percent by weight and pigmented particles present in an amount of from about 10 percent by weight to about 50 percent by weight sufficient to render said coating on said another surface readily receptive to being written on with pen or pencil.

The coating compositions discussed above can be applied to the substrate by any suitable technique. For example, the coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25° to about 100° C. in an air drier.

Laminated imaged substrates of the present invention exhibit reduced curl upon being printed with aqueous inks. Generally, the term "curl" refers to the distance between the base line of the arc formed by the imaged substrate when viewed in cross-section across its width (or shorter dimension—for example, 8.5 inches in an 8.5 by 11 inch sheet, as opposed to length, or longer dimension—for example, 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The gloss values recited herein were obtained on a 75° Glossmeter, Glossgard II from Pacific Scientific (Gardner/Neotec Instrument Division).

The optical density measurements recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of the magnetic coating 103 and abrasion resistant coating 104 which can be written upon with a pen:

Twenty coated backing substrates were prepared by the solvent extrusion process (single side each time initially) on a Faustel Coater using a one slot die, by providing portions of each opaque polyester Mylar® (roll form) with a thickness of 75 microns with a coating 103 which is magnetic, from a ball milled blend comprised of 20 percent by weight of polyester latex (Eastman AQ 29D), 5 percent by weight of 2-amino-2-methyl-1,3-propane diol, available as AMPD, from Angus Corporation, 5 percent by weight of 2-methyl-3-propyl benzothiazolium iodide (Aldrich #36,329-4), and 70 percent by weight of Barium ferrite, #38,329-5, available from Aldrich Chemical Company, which blend was present in a concentration of 35 percent by weight in water. Subsequent to air drying at 105° C. and monitoring the difference in weight prior to and subsequent to coating, the dried Mylar® rolls contained 0.5 gram, 5 microns in thickness of the magnetic coating. The uncoated part of the backing sheet containing coating 103 was then coated with an abrasion resistant coating 104 from a blend comprised of 40 percent by weight of polyester latex (Eastman AQ 29D), 5 percent by weight of 2-amino-2-methyl-1,3-propane diol, available as AMPD, from Angus Corporation, 5 percent by weight of 2-methyl-3-propyl benzothiazolium iodide(Aldrich 36,329-4), and 50 percent by weight of calcium carbonate (Microwhite Sylacauga Calcium Products), which blend was present in a concentration of 35 percent by weight in water. Subsequent to air drying at 105° C. and monitoring the difference in weight prior to and subsequent to coating, the dried Mylar® rolls contained 1.0 grams, 10 microns in thickness of the abrasion resistant coating.

Preparation of two layered adhesive coating 100/102 for adhering backing substrates to imaged transparent substrates:

Rewinding the opaque polyester Mylar® (roll form) containing coating 103/104 on to an empty core and using these rolls, the uncoated sides of the opaque polyester Mylar® were coated with a heat and pressure sensitive coating combination 100/102. This two layered 100/102 coating structure was prepared by the solvent extrusion process on a Faustel Coater using a two slot die, by providing for each an opaque Mylar® base (roll form) with a thickness of 100 microns and coating the base simultaneously with two polymeric layers where the first layer 100 in contact with the substrate was comprised of a blend of 90 percent by weight acrylic emulsion latex, Rhoplex B-15J, from Rohm and Haas Company, 5.0 percent by weight of the antistatic agent Alkasurf SS-0-75, available from Alkaril Chemicals, 3.0 percent by weight of the UV absorbing compound poly[N, N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound N,N'-β,β'-naphthalene-4-phenylenediamine, available as Anchor DNPD, from Anchor Corporation, which composition was present in a concentration of 35 percent by weight in water and the second layer in contact with the first layer was a polymer having excellent image-wetting properties such as poly (ethylene oxide) (POLYOX WSRN-3000, obtained from Union Carbide Company) present in a concentration of 2 percent by weight in water. Subsequent to air drying the two layers simultaneously at 100° C. and monitoring the difference in weight prior to and subsequent to coating, the dried opaque polyester Mylar® rolls were coated with 1.5 gram, 15 microns in thickness of Rhoplex B-15J containing composition overcoated with poly(ethylene oxide). The opaque polyester Mylar®, coated backing substrates were cut from this roll in sizes of 8.5 by 11.0 inches.

Preparation of the xerographic image on transparencies containing coating 99:

20 sheets of Fuji Xerox COLOR OHP Transparency were fed into a Fuji Xeroxcolor copier and images were obtained having optical density values of 1.20 (cyan), 1.15 (magenta), 0.77 (yellow) and 1.35 (black).

Lamination of image on transparency containing coating 99 with the coated backing sheet containing coatings 102–104.

The imaged side of the Fuji Xerox COLOR OHP Transparency was brought in contact with the heat and pressure sensitive side of the coated backing sheet and laminated thereto at 140° C. and a pressure of 100 psi for 2 minutes in a Model 7000 Laminator from Southwest Binding Systems, Ontario, Canada. The laminated structure of Fuji Xerox COLOR OHP transparency and opaque polyester Mylar® had a gloss of 140 units, and had optical density values of 1.35 (cyan), 1.23 (magenta), 0.89 (yellow) and 1.58 (black). The backside of the laminated sheets were capable of magnetic recording, thereby yielding a simulated photographic image containing plastic card bearing a unique magnetic bar code for security identifications and key card/credit card applications. The abrasion resistant nonmagnetic coating accepted smudge resistant water fast signature from a pen.

EXAMPLE II

Preparation of the magnetic coating 103 and abrasion resistant coating 104 which can be written upon with a pen.

Twenty coated backing substrates were prepared by the solvent extrusion process on a Faustel Coater using a one slot die, by providing a portion of each opaque polyester Mylar® (roll form) with a thickness of 75 microns with a coating 103 which is magnetic, from a ball milled blend comprised of 20 percent by weight of vinyl alcohol-vinyl acetate copolymer such as #379, available from Scientific Polymer Products, 5 percent by weight of oleic hydroxyethyl imidazoline, available as Alkazine-O, from Rhone-Poulenc Corporation, 5 percent by weight of 2-methyl-3-propyl benzothiazolium iodide (Aldrich #36,329-4), and 70 percent by weight of Barium ferrite, #38,329-5, available from Aldrich Chemical Company, which blend was present in a concentration of 20 percent by weight in methanol. Subsequent to air drying at 105° C. and monitoring the difference in weight prior to and subsequent to coating, the dried Mylar® rolls contained 1.0 gram, 10 microns in thickness, of the magnetic coating. The uncoated part of the backing sheet containing coating 103 was coated with an abrasion resistant coating 104 from a blend comprised of 40 percent by weight of vinyl alcohol-vinyl acetate copolymer such as #379, available from Scientific Polymer Products, 5 percent by weight of oleic hydroxyethyl imidazoline, available as Alkazine O, from Rhone-Poulenc Corporation, 5 percent by weight of 2-methyl-3-propyl benzothiazolium iodide, (Aldrich 36,329-4), and 50 percent by weight of calcium carbonate (Microwhite Sylacauga Calcium Products, which blend was present in a concentration of 20 percent by weight in Methanol. Subsequent to air drying at 105° C. and monitoring the difference in weight prior to and subsequent to coating, the dried Mylar® rolls contained 1.0 grams, 10 microns in thickness of the abrasion resistant coating.

Preparation of two layered adhesive coating 100/102 for adhering backing substrates to imaged transparent substrates.

Rewinding the opaque polyester Mylar®, (roll form) containing coatings 103–104 on to an empty core and using these rolls, the uncoated sides of the opaque polyester Mylar® were coated with a heat and pressure sensitive coating combination 100/102. This two layered coating structure was prepared by the solvent extrusion process (single side each time initially) on a Faustel Coater using a two slot die, by providing for each an opaque Mylar® base (roll form) with a thickness of 100 microns and coating the base simultaneously with two polymeric layers where the first layer 100 in contact with the substrate was comprised of a blend containing 90 percent by weight of poly(2-ethylhexyl methacrylate), such as #229, available from Scientific Polymer Products, 5 percent by weight of the antistat 2-methyl-3-propyl benzothiazolium iodide Aldrich 36,329-4),3 percent by weight of UV absorbing compound poly[2-(4-benzoyl-3-hydroxyphenoxy)ethylacrylate] (Cyasorb UV-2126, #41,323-2, available from Aldrich chemical company),and 2 percent by weight of an antioxidant compound, 2,2'-isobutylidene-bis(4,6-dimethyl phenol), available as Vulkanox NKF, from Mobay Chemicals present in a concentration of 10 percent by weight in toluene. The second layer 102 in contact with the first layer was a polymer having excellent image-wetting properties such as epichlorohydrin-ethylene oxide copolymer such as #155 available from Scientific Polymer Products present in a concentration of 2 percent by weight in toluene Subsequent to air drying the two layers simultaneously at 100° C. and monitoring the difference in weight prior to and subsequent to coating, the dried opaque Mylar® rolls were coated with 1.5 gram, 15 microns in thickness, of poly(2-ethylhexyl methacrylate) overcoated with epichlorohydrin-ethyleneoxide copolymer. The coated backing substrates were cut from this roll in 8.5 by 11.0 inches cut sheets.

Preparation of the ink jet ink images on transparency containing coating 99.

Transparencies containing coating 99 were prepared as follows.

Blends of 54 percent by weight hydroxypropyl methyl cellulose (K35LV, obtained from Dow Chemical Co.), 36 percent by weight poly(ethylene oxide) (POLY OX WSRN-3000, obtained from Union Carbide Corp., and 10 percent by weight of various additive compositions, each obtained from Aldrich Chemical Co., were prepared by mixing 43.2 grams of hydroxypropyl methyl cellulose, 28.8 grams of poly (ethylene oxide), and 8 grams of the additive 4-morpholine propane sulfonic acid in the composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5 by 11 inches) in a thickness of 100 microns. Subsequent to air drying at 25° C. for 3 hours followed by oven drying at 100° C. for 10 minutes and monitoring the difference in weight prior to and subsequent to coating, the dried coated transparencies each contained 1 gram, 10 microns in thickness of the blend, on each surface (2 grams total coating weight for 2-sided transparency) of the substrate.

The transparencies thus prepared were incorporated into a color ink jet printer equipped with reverse image writing capability and containing inks of the following compositions.

Cyan: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 35 percent by weight Projet Cyan 1 dye, obtained from ICI, 34.285 percent by weight deionized water.

Magenta: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl) aminomethane obtained from Aldrich Chemical company, 0.35 percent by weight EDTA(ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 25 percent by weight Projet magenta 1T dye, obtained from ICI, 4.3 percent by weight Acid Red 52 obtained from Tricon Colors, 39.985 percent by weight deionized water.

Yellow: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 27.0 percent by weight Projet yellow 1G dye, obtained from ICI, 20.0 percent by weight Acid yellow 17 obtained from Tricon Colors, 22.285 percent by weight deionized water.

Images were generated having optical density values of 1.40 (cyan),1.17 (magenta),0.80 (yellow) and 1.75 (black).

Lamination of imaged transparency containing coating 99 with the backing substrate containing coating 100/102.

The imaged side of the transparency was brought in contact with the heat and pressure sensitive adhesive side of the coated backing substrate and laminated together at 150° C. and a pressure of 100 psi for 2 minutes in a Model 7000 Laminator from Southwest Binding Systems, Ontario, Canada. The laminated structure of opaque polyester Mylar®, and transparent printed Mylar® had a gloss of 125 units, and optical density values of 1.47 (cyan), 1.25 (magenta), 0.90 (yellow) and 1.90 (black). These images were waterfast when washed with water for 2 minutes at 50° C. and lightfast for a period of three months without any change in their optical density. The backside of the laminated substrates were capable of magnetic recording, thereby yielding a simulated photograph image containing plastic card bearing a unique magnetic bar code for security identifications and key card/credit card applications. The abrasion resistant nonmagnetic coating accepted smudge resistant water fast signature from a pen.

EXAMPLE III

Preparation of the magnetic coating 103 and abrasion resistant coating 104 which can be written upon with a pen.

Twenty coated backing substrates were prepared by the solvent extrusion process (single side each time initially) on a Faustel Coater using a one slot die, by providing a portion of each opaque polyester Mylar®, (roll form) with a thickness of 100 microns with a coating 103 which is magnetic, from a ball milled blend comprised of 20 percent by weight of vinyl alcohol-vinyl acetate copolymer such as #379, available from Scientific Polymer Products, 10 percent by weight of 2-phosphino-butane-tricarboxylic acid-1,2,4, available as Bayhit-AM, from Mobay Corporation and 70 percent by weight of Barium ferrite, #38,329-5, available from Aldrich Chemical Company, which blend was present in a concentration of 25 percent by weight in methanol. Subsequent to air drying at 105° C. and monitoring the difference in weight prior to and subsequent to coating, the dried Mylar® rolls contained 1.0 gram, 10 microns in thickness of the magnetic coating. After rewinding the opaque polyester Mylar® (roll form) containing coating 103, the uncoated part of the backing substrate containing coating 103 was coated with an abrasion resistant coating 104 from a blend comprised of 40 percent by weight of vinyl alcohol-vinyl acetate copolymer such as #379, available from Scientific Polymer Products, 10 percent by weight of 2-phosphino-butane-tricarboxylic acid-1,2,4, available as Bayhit-AM, from Mobay Corporation and 50 percent by weight of calcium carbonate (Microwhite Sylacauga Calcium Products, which blend was present in a concentration of 20 percent by weight in methanol. Subsequent to air drying at 105° C. and monitoring the difference in weight prior to and subsequent to coating, the dried Mylar® rolls contained 1.0 grams, 10 microns in thickness, of the abrasion resistant coating.

Preparation of two layered adhesive coating 100/102 for adhering backing substrates to imaged transparent substrates.

Rewinding the opaque polyester Mylar®, (roll form) containing coating 103 on to an empty core and using these rolls, the uncoated sides of the opaque polyester Mylar®, were coated with a heat and pressure sensitive coating combination 100/102. This two layered coating structure was prepared by the solvent extrusion process (single side each time initially) on a Faustel Coater using a two slot die, by providing for each an opaque Mylar® sheet (roll form) with a thickness of 100 microns and coating the base sheet simultaneously with two polymeric layers where the first layer 100 in contact with the substrate was comprised of a blend containing 90 percent by weight of poly(2-ethylhexyl methacrylate), such as #229, available from Scientific Polymer Products, 5 percent by weight of the antistat 2-methyl-3-propyl benzothiazolium iodide Aldrich 36,329-4),3 percent by weight of UV absorbing compound poly[2-(4-benzoyl-3-hydroxyphenoxy)ethylacrylate](Cyasorb UV-2126, #41,323-2, available from Aldrich chemical company), and 2 percent by weight of an antioxidant compound, tris(4-tert-butyl-3-hydroxy-2,6-dimethylbenzyl) isocyanurate, available as Cyanox 1790, #41,322-4, from Aldrich chemical company present in a concentration of 10 percent by weight in toluene. The second layer 102 in contact with the first layer was a polymer having excellent image-wetting properties such as tris(4-tert-butyl-3-hydroxy-2,6-dimethylbenzyl) isocyanurate, available as Cyanox 1790, #41,322-4, from Aldrich chemical company present in a concentration of 10 percent by weight in toluene. The second layer 102 in contact with the first layer was a polymer having excellent image-wetting properties such as epichlorohydrin-ethylene oxide copolymer such as #155 available from Scientific Polymer Products present in a concentration of 2 percent by weight in toluene Subsequent to air drying the two layers simultaneously at 100° C. and monitoring the difference in weight prior to and subsequent to coating, the dried opaque Mylar® rolls were coated with 1.5 gram, 15 microns in thickness, of poly(2-ethylhexyl methacrylate) overcoated with epichlorohydrin-ethyleneoxide copolymer. The coated backing substrates were cut from this roll in 8.5 by 11.0 inches cut sheets.

Preparation of the xerographic image on transparencies containing coating 99.

20 sheets of Fuji Xerox COLOR OHP Transparency were fed into a Fuji Xeroxcolor copier and images were obtained having optical density values of 1.20 (cyan), 1.15 (magenta), 0.77 (yellow) and 1.35 (black).

Lamination of image on transparency containing coating 99 with the coated backing substrates containing coating 100/102.

The imaged side of the Fuji Xerox COLOR OHP Transparency was brought in contact with the heat and pressure sensitive side of the coated backing substrate and laminated thereto at 140° C. and a pressure of 100 psi for 2 minutes in a Model 7000 Laminator from Southwest Binding Systems, Ontario, Canada. The laminated structure of Fuji Xerox COLOR OHP transparency and opaque polyester Mylar® had a gloss of 140 units, and had optical density values of 1.35 (cyan), 1.23 (magenta), 0.89 (yellow) and 1.58 (black). The backside of the laminated substrates were capable of magnetic recording, thereby yielding a simulated photograph image containing plastic card bearing a unique magnetic bar code for security identifications and key card/credit card applications. The abrasion resistant nonmagnetic coating accepted smudge resistant water fast signature from a pen.

Other embodiments and modifications of the present invention may occur to those skilled in the art subsequent to a review of the information presented herein, these embodiments and modifications, as well as equivalents thereof, are also included within the scope of this invention.

What is claimed is:

1. A method of creating simulated photographic-quality prints using non-photographic imaging, said method comprising:

providing a coated transparent substrate having a reverse reading toner image formed thereon using a non-photographic imaging process;

providing a backing member having one surface thereof coated with a two layered adhesive material, wherein a first layer in contact with the substrate has a polymeric binder having glass transition of less than 55° C., an antistatic agent, a lightfastness inducing agent, an optional filler and the second layer in contact with the first layer has a material with a melting temperature of greater than 50° C., an antistatic agent, a lightfastness inducing agent, an optional filler, for adhering said backing member to a surface of said transparent substrate containing said reverse reading toner image;

providing a third, magnetic coating on one part of another surface of said backing member opposite said one surface;

providing a fourth coating on another part of said another surface of said backing member opposite said one side, said fourth coating comprising an abrasion resistant coating containing a binder present in an amount of from about 30 percent to about 80 percent by weight of said fourth coating, a pigment dispersant present in an amount of from about 10 to about 20 percent by weight of said fourth coating and pigmented particles present in an amount of from about 10 to about 50 percent by weight of said fourth coating for rendering said fourth coating readily receptive to being written on with pen or pencil; adhering the transparent imaged substrate to the two layered adhesive containing side of said backing member using heat and pressure.

2. The method according to claim 1 wherein said step of providing a transparent substrate comprises providing a substrate containing a xerographically formed image.

3. The method according to claim 1 wherein said step of providing a transparent substrate comprises providing a substrate containing an Inkjet formed image.

4. The method according to claim 1 wherein said step of providing a backing comprises selecting a substrate from the group consisting of polyethylene terephthalate, polyethylene naphthalates, polycarbonates, polysulfones, polyether sulfones, poly, cellulose triacetate, polyvinylchloride, cellophane, polyvinyl fluoride, polypropylene, polyimides, and coated papers.

5. The method according to claim 4 wherein said step of providing said coating having a binder with a glass transition temperature of less than 55° C. comprises providing a latex binder selected from the group consisting of rubber latex polyester latex vinyl-chloride latex, ethylene-vinyl chloride copolymer latex, poly vinyl acetate homopolymer latex, ethylene-vinyl acetate copolymer latex, acrylic-vinyl acetate copolymer latex, vinyl acrylic terpolymer latex, polystyrene latex, styrene-butadiene latex, butadiene-acrylonitrile latex, and butadiene-acrylonitrile-styrene terpolymer latex.

6. The method according to claim 4 wherein said step of providing said coating having a binder with a glass transition temperature of less than 55° C. comprises providing a water soluble binder selected from the group consisting of melamine-formaldehyde resin, urea-formaldehyde resin, alkylated urea-formaldehyde resins, vinyl methyl ether-maleic anhydride copolymer, ethylene-maleic anhydride copolymers, butadiene-maleic acid copolymers, octadecene-1-maleic anhydride copolymer polyvinylmethylether vinylmethylether-maleic acid copolymer, and methyl vinyl ether-maleic acid ester.

7. The method according to claim 4 wherein said step of providing said coating having a binder with a glass transition temperature of less than 55° C. comprises providing a solvent soluble binder selected from the group consisting of: ethylcellulose, poly(2-hydroxyethylmethacryle), poly(2-hydroxyethyl acrylate), poly(hydroxypropylacrylate), hydroxyethyl cellulose acrylate, hydroxyethyl cellulose methacrylate, poly(methyl acrylate), poly(ethyl acrylate), poly(n-propyl acrylate), poly(isopropyl acrylate), poly(n-butyl acrylate), poly(tert-butyl acrylate), poly(2-methoxy ethyl acrylate), poly(benzyl acrylate), poly(n-hexyl acrylate), poly(2-ethylhexyl acrylate), poly(octyl acrylate), poly(isooctylacrylate), poly(decylacrylate), poly(isodecyl acrylate), poly(lauryl acrylate), poly(cyclohexyl acrylate), poly(octadecyl acrylate), poly(n-propyl methacrylate), poly (n-butyl methacrylate), poly(n-butyl methacrylate-co-isobutylmethacrylate), poly(tert-butylaminoethyl methacrylate), poly(n-hexyl methacrylate), poly(2-ethylhexyl methacrylate), poly(n-decyl methacrylate), poly (isodecyl methacrylate), poly(lauryl methacrylate), poly (octadecyl methacrylate), polyethylene polypropylene, poly (1-butene), poly(isobutylene), ethylene-propylene copolymer, ethylene-ethylacrylate copolymer, isobutylene-co-isoprene copolymer, ethylene-propylene-diene terpolymer, polyisoprene, polychloroprene, polybutadiene, polybutadiene phenyl terminated, polybutadienedicarboxy terminated, polyvinylisobutylether, octadecene-1-maleic anhydride copolymer, poly(vinyl stearate), poly(vinyl propionate), poly(vinyl pivalate), poly(vinyl neodecanoate), poly (vinyl acetate), poly(ethylene adipate), poly(ethylene succinate), poly(ethylene azelate), poly(1,4-butylene adipate) poly(trimethylene adipate), poly(trimethylene glutarate), poly(trimethylene succinate), poly (hexamethylene succinate), poly(diallyl phthalate), poly (diallyl isophthalate), and polyesters.

8. The method according to claim 1 wherein said material having a melting point of greater than 50° C. comprises a hydrophilic-polyoxyalkylene containing polymer.

9. The method according to claim 8 wherein said hydrophilic-polyoxyalkylene containing polymer is selected from the group consisting of poly (ethylene oxide), ethylene oxide/propylene oxide copolymers, ethylene oxide/2-hdyroxyethylmethacrylate/ethyleneoxide, ethylene oxide/hydroxypropyl methacrylate/ethylene oxide triblock copolymers, ionene/ethylene oxide/ionene triblock copolymers, ethylene oxide/isoprene/ethylene oxide triblock copolymers, epichlorohydrin-ethylene oxide copolymer; and mixtures thereof.

10. The method according to claim 1 wherein said magnetic coating comprises a binder is selected from the group consisting of poly (vinyl acetate), poly (vinyl formal), poly (vinyl butyral), vinyl alcohol-vinyl butyral copolymers, vinyl alcohol-vinyl acetate copolymers, vinyl chloride-vinyl acetate copolymers, vinyl chloride-vinyl acetate vinyl alcohol terpolymers, vinyl chloride-vinylidene chloride copolymers, cyanoethylated cellulose, cellulose acetate hydrogen phthalate, hydroxypropylmethyl cellulose phthalate, hydroxypropyl methyl cellulose succinate, cellulose triacetate, cellulose acetate butyrate, (acrylamidomethyl) cellulose acetate butyrate, cellulose propionate, polystyrene, poly (4-methylstyrene), poly (α-methylstyrene), poly (tert-butylstyrene), poly (chlorostyrene), poly (bromostyrene), poly (methoxy styrene), poly (2,4,6-tribromostyrene), styrene-butylmethacrylate copolymers, styrene-acrylonitrile copolymers, styrene-allyl alcohol copolymers, poly(vinyl pyridine) poly(vinyl pyridine-co-styrene), poly(4-vinyl pyridine-co-butylmethacrylate), poly(vinyl toluene), poly(2-vinylnaphthalene), poly(methylmethacrylate), poly (ethyl methacrylate), poly(phenyl methacrylate), polyamide resin, poly (p-phenylene ether-sulfone), polycarbonate, α-methylstyrene-dimethylsiloxane block copolymers, dimethyl siloxane-bisphenol A carbonate block copolymers, poly (2,6-dimethyl p-phenylene oxide), and mixtures thereof.

11. The method according to claim 10 wherein said third magnetic coating is comprised of from about 20 percent by weight to about 50 percent by weight of a binder, from about 10 percent by weight to about 30 percent by weight of a magnetic compound dispersing agent, from about 20 percent by weight to about 70 percent by weight of the magnetic compound.

12. The method according to claim 11 wherein said magnetic compound is selected from the group consisting of $\gamma$-$Fe_2O_3$, $Fe_3O_4$, mixed crystals of $\gamma$-$Fe_2O_3$ and $Fe_3O_4$, chromium oxide, cobalt oxide, barium ferrite, strontium ferrite; and mixtures thereof.

13. The method according to claim 12 wherein said magnetic compound dispersing agent is selected from the group consisting of 2-amino-2-methyl-1-propanol, 2-amino-2-methyl-1,3-propane diol, 2-amino-2-ethyl-1,3-propane diol, 2-nitro-1-butanol, 2-nitro-2-ethyl-1,3-propanediol, oleic-hydroxyethylimidazoline, stearyl hydroxyethyl imidazoline, tall Oil hydroxyethyl imidazoline, alkyl poly (ethyleneoxy)glycol amide, poly ethylene glycol esters alkyl trimethyl ammonium halides, tallow amines, poly ethylene glycol amines, 2-phosphino-butane-tricarboxylic acid-1,2,4, mono, di, and tetra sodium alkyl sulfosuccinates sodium naphthalene sulfonate sodium tetraborate decahydrate, poly-L-glutamate sodium salt, polyacrylate sodium salt, polyacrylate ammonium salt, and poly naphthalene sulfonate sodium salt.

14. The method according to claim 13 wherein said binder of said abrasion resistant coating is selected from the group consisting of poly (vinyl acetate), poly (vinyl formal), poly (vinyl butyral), vinyl alcohol-vinyl butyral copolymers, vinyl alcohol-vinyl acetate copolymers, vinyl chloride-vinylacetate-copolymers, vinylchloride-vinylacetate-vinylalcohol terpolymers, vinyl chloride-vinylidene chloride copolymers, cyanoethylated cellulose, cellulose acetate hydrogen phthalate, hydroxypropylmethyl cellulose phthalate, hydroxypropyl methyl cellulose succinate, cellulose triacetate, cellulose acetate butyrate, (acrylamidomethyl) cellulose acetate butyrate, cellulose propionate, polystyrene, poly (4-methylstyrene), poly (α-methylstyrene), poly (tert-butylstyrene), poly (chlorostyrene), poly (bromostyrene), poly (methoxy styrene), poly (2,4,6-tribromostyrene), styrene-butylmethacrylate copolymers, styrene-acrylonitrile copolymers, styrene-allyl alcohol copolymers, poly(vinyl pyridine) poly(vinyl pyridine-co-styrene), poly(4-vinyl pyridine-co-butylmethacrylate), poly(vinyl toluene), poly(2-vinylnaphthalene), poly(methylmethacrylate), poly (ethyl methacrylate), poly(phenyl methacrylate), polyamide resin, poly (p-phenylene ether-sulfone), polycarbonate, α-methylstyrene-dimethylsiloxane block copolymers, dimethyl siloxane-bisphenol A carbonate block copolymers, and poly (2,6-dimethyl p-phenylene oxide).

15. The method according to claim 1 wherein said fourth coating on said another surface of said backing member comprises a dispersant for the abrasion resistant coating which is selected from the group consisting of 2-amino-2-methyl-1-propanol, 2-amino-2-methyl-1,3-propane diol, 2-amino-2-ethyl-1,3-propane diol, 2-nitro-1-butanol, 2-nitro-2-ethyl-1,3-propanediol, oleic-hydroxyethylimidazoline, stearyl hydroxyethyl imidazoline, tall Oil hydroxyethyl imidazoline, alkyl poly(ethyleneoxy) glycol amide, poly ethylene glycol esters alkyl trimethyl ammonium halides, tallow amines, poly ethylene glycol amines, 2-phosphino-butane-tricarboxylic acid-1,2,4, mono, di, and tetra sodium alkyl sulfosuccinates, sodium naphthalene sulfonate, sodium tetraborate decahydrate, poly-L-glutamate sodium salt, polyacrylate sodium salt, polyacrylate ammonium salt, and poly naphthalene sulfonate sodium salt.

* * * * *